US005276599A

United States Patent [19]

Neeley

[11] Patent Number: 5,276,599

[45] Date of Patent: Jan. 4, 1994

[54] LIGHT SCULPTURE DEVICE

[76] Inventor: Willard L. Neeley, 1011 Valley River Way 116B-307, Eugene, Oreg. 97401

[21] Appl. No.: 838,835

[22] Filed: Feb. 21, 1992

[51] Int. Cl.[5] ..... F21V 7/05

[52] U.S. Cl. ..... 362/301; 362/373; 362/800; 362/806; 362/811

[58] Field of Search ..... 362/240, 247, 294, 301, 362/345, 310, 373, 800, 811, 806; 40/442

[56] References Cited

U.S. PATENT DOCUMENTS

| | | | |
|---|---|---|---|
| 1,623,086 | 4/1927 | Bock | 362/351 |
| 3,019,701 | 2/1962 | Brueckner et al. | 362/294 |
| 3,610,918 | 10/1971 | Barlow | 40/432 |
| 3,611,603 | 10/1971 | Gesner | 40/442 |
| 3,694,645 | 9/1972 | Brantz | 40/432 |
| 3,790,772 | 2/1974 | Newman et al. | 40/444 |
| 3,840,732 | 10/1974 | Cohen | 362/294 |
| 4,121,279 | 10/1978 | Whitesel | 362/811 |
| 4,164,823 | 8/1979 | Marisco | 362/811 |
| 4,259,709 | 3/1981 | Eddings | 362/240 |
| 4,591,920 | 5/1986 | Yano | 40/442 |
| 4,843,524 | 6/1989 | Krent et al. | 362/127 |

*Primary Examiner*—Albert J. Makay
*Assistant Examiner*—L. Heyman
*Attorney, Agent, or Firm*—Richard C. Litman

[57] ABSTRACT

A light sculpture device, and more specifically, an article of furniture which displays light patterns, includes a box-like enclosure mounted on a hollow base. The enclosure includes a plurality of planar mirrored panels joined together at right angles to form a substantially rectangular structure in such that the reflective surfaces are directed interiorly of the enclosure. At least one of the planar mirrored panels is translucent to permit an observer to view inside of the enclosure. A plurality of lights are secured to the hollow base which emit light within the enclosure. The light pattern is produced by the light source along with the reflections of the light source produced on the reflective surfaces. This light pattern is viewed through the translucent planar mirrored panel. The light source can be but is not limited to a plurality of incandescent sources, low voltage sources, light emitting diodes, or even a visual display. The light source can be controlled by a device such as a sound activated circuit or a voice activated circuit or processing system and an input device and accompanying software. Also provided is a ventilation system for circulating air throughout the light sculpture device, thus minimizing the heat generated by the light source.

19 Claims, 2 Drawing Sheets

LIGHT SCULPTURE DEVICE

BACKGROUND OF THE INVENTION

1. Field of the Invention

The present invention relates to a light sculpture device and, more specifically, to an article of furniture which displays a light pattern.

2. Description of Prior Art

Illuminating apparatuses have gained widespread popularity. In some applications, such as with sales establishments, the use of the device is intended to gain the attention of prospective buyers. In other applications, such as in clubs, restaurants, and lounges, the intended use is merely for decorative purposes or for the amusement of patrons.

U.S. Pat. No. 3,610,918 issued Oct. 5, 1971 to Gordon A. Barlow discloses a plurality of planar reflective panels and at least one transparent panel angularly joined together to form a hollow body containing a light source. The light source along with reflections of the light source on one or more of the reflective panels is viewed through the transparent panel.

U.S. Pat. No. 3,694,645 issued Sep. 26, 1972 to Malcolm H. Brantz shows an illuminated display including a housing having a front panel through which continuously changing light patterns are viewed.

U.S. Pat. No. 3,790,772 issued Feb. 5, 1974 to Peter M. Newman et al. discloses a light box assembly which includes a box-like structure having interiorly mirrored walls and multiple light sources mounted on walls within the box which continuously activate and deactivate to change a light pattern.

U.S. Pat. No. 4,843,524 issued Jun. 27, 1989 to Edward D. Krent et al. shows furniture or the like having an illuminated, decorative design formed on at least one surface thereof.

None of the above inventions and patents, taken either singly or in combination, is seen to describe the instant invention as claimed.

SUMMARY OF THE INVENTION

The present invention provides a light sculpture device or an article of furniture which displays a light pattern, and preferably, displays a dynamic light pattern. The device includes a plurality of planar mirrored panels, at least one of which is translucent, angularly joined together to form a box-like enclosure having interiorly reflective walls. The enclosure is mounted on a base. An intermediate top planar mirrored panel is interposed between the enclosure and the base. The top planar mirrored panel reflects interiorly of the enclosure and a light source originates thereabout. The light source may be a plurality of light sources located on pylons mounted to and extending above the top planar mirrored panel into the enclosure. Alternatively, a plurality of light sources may be recessed within the top planar mirrored panel or may be mounted beneath the top planar mirrored panel providing that pathways exist in the top planar mirrored panel which permit the passage of light therethrough. Each mirrored panel produces a reflection of the illumination light source or light sources. The illuminating light and multiple reflection produced thereby can be viewed through the translucent planar mirrored panel. The light source can be continuously activated and deactivated, such as by a noise responsive device, or a visual display can be substituted in the place of the top planar mirrored panel which can exhibit a continuously changing light pattern generated by an electronic processing system, an input device, and related software. To reduce the risk of excess heat produced by the light source, a ventilation system is provided to circulate air within the device.

Accordingly, one object of the present invention is to provide a light sculpture device which permits a viewer to view a light source as well as a series of reflections produced by the light source.

Another object of the present invention is to provide a light sculpture device having a dynamic light source which produces a continuously changing visual effect.

Another object of the present invention is to provide a light sculpture device which displays a light pattern containing a variety of colors.

Further, an object of the present invention is to provide a ventilation system to circulate air through the device, thus reducing the heat being produced by the light source.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figures 1, 2:
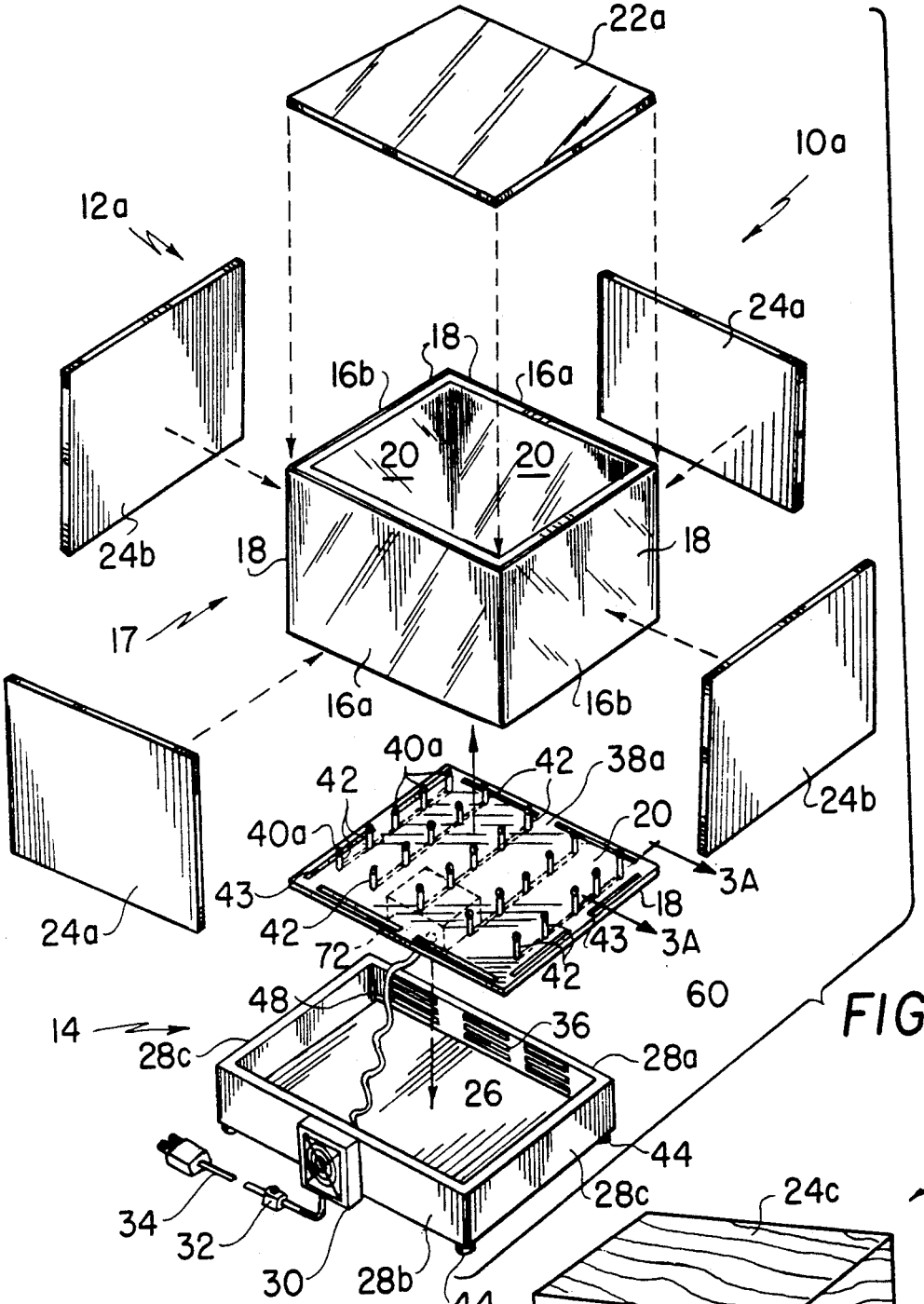
FIG. 1 is an exploded perspective view of the present invention.
FIG. 2 is a perspective view of the present invention.

Now referring to the drawings, FIG. 1 shows the present invention, a light sculpture device **10*a* or an article of furniture which displays a light pattern. The light sculpture device 10*a* includes generally a box-like enclosure 12*a* and a substantially rectangular hollow base 14**.

Front and back planar mirrored panels **16*a* are joined to left and right planar mirrored panels 16*b* at right angles to form a first rectangular shaped structure 17. A translucent planar mirrored panel 22*a* is joined adjacent the top of the first rectangular shaped structure 17 to form the enclosure 12*a* having an open bottom. Silvered surfaces 18 of the planar mirrored panels 16*a*, 16*b*, 22*a* are located exteriorly of the enclosure 12*a*, thus providing reflective surfaces 20 directed interiorly of the enclosure 12*a*. Front and back protective panels 24*a* are joined substantially perpendicularly to left and right protective panels 24*b*** to form a protective structure around the outside of the first rectangular shaped structure 17. The purpose of these protective panels 24*a*, 24*b* is to safeguard the silvered surface 18 against damage.

The hollow base 14 includes front and rear walls 28*a*, 28*b* and left and right walls 28*c* joined to form a second rectangular shaped structure 60. A bottom panel 26 is joined adjacent the bottom of the second rectangular shaped structure 60 and an intermediate top planar mirrored panel 38*a* is joined adjacent the top of the second rectangular shaped structure 60 and interposed between the enclosure 12*a* and the hollow base 14. The top planar mirrored panel 38*a* has a silvered surface 18 located interiorly of the hollow base 14. The top planar mirrored panel 38*a* is mounted intermediate the enclosure 12*a* and the hollow base 14 such that the reflective surface 20 is directed upwards through the open bottom of the enclosure 12*a* and interiorly of the enclosure 12*a*. The top planar mirrored panel 38*a* further includes a series of bores 46 having pylons 42 inserted therein, each pylon 42 having a light source 40*a* mounted thereon. Each individual light source 40*a* is connected in parallel by a pair of conductors 48 (also shown in FIG. 3A). The light sources 40*a* can be controlled either sequentially or randomly by a control device such as, but not limited to, a sound activated circuit or a voice activated circuit VAC 72 (shown in FIG. 5A) or a processing system 74, an input device 78, and accompanying software see FIG. 5B). Openings or slots 43 are provided in the top planar mirrored panel 38*a* to enable the heat produced by the light sources 40*a* to escape from the enclosure 12*a*. Moreover, the back wall 28*b* of the hollow base 14 has an exhaust fan 30 mounted thereon and the front wall 28*a* of the hollow base 14 includes a series of openings or slots 36 therein which in combination circulate air through the light sculpture device 10*a*, thus further ensuring adequate ventilation. The hollow base 14 is elevated by a set of legs 44 allowing air to circulate under the light sculpture device 10*a*. This gap further reduces the risk of excess heat within the light sculpture device 10*a* by allowing the heat to dissipate from the bottom panel 26. A power cord 34 is provided as a means to supply power from the power source 68 (shown in FIGS. 5A and 5B) for the operation of both the light sources 40*a* and the exhaust fan 30. A switch 32 is also provided to enable and disable the power supplied by the power source 68.

FIG. 2 illustrates an alternative embodiment to that shown in FIG. 1. A translucent planar mirrored panel 22*b* enables viewing to be permitted through the front of the enclosure 12*b*. The light sources 40*a* (shown in FIG. 1) as well as a series of reflections of light produced by the reflective surfaces 20 (also shown in FIG. 1) are viewed through the translucent planar mirrored panel 22*b*. The protective panels 24*c*, 24*d* are provided to protect the silvered surfaces (illustrated in FIG. 1) against damage.

Figure 3A:
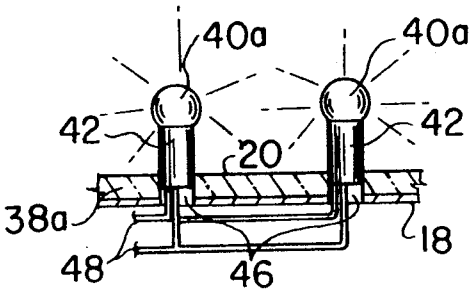
FIG. 3A is a cross-sectional view of the present invention taken along the line 3A—3A shown in FIG. 1.

FIG. 3A shows the pylons 42 mounted to and projecting from the bores 46 in the top planar mirrored panel 38*a*, each having a light source 40*a* mounted thereon. The light sources 40*a* are connected in parallel to the power source 68 (shown in FIG. 5A–5B) by the conductors 48.

Figure 3B:
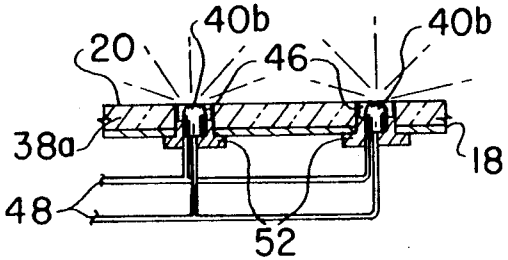
FIGS. 3B-3C are similar to FIG. 3A, illustrating alternative lighting embodiments.

An alternative placement of the light sources 40*b* is shown in FIG. 3B. The light sources 40*b* are recess mounted within the bores 46 in the top planar mirrored panel 38*a* and are secured by a holder 52 such as a grommet. The light sources 40*b* are connected in parallel to the power source 68 by the conductors 48.

Figure 3C:
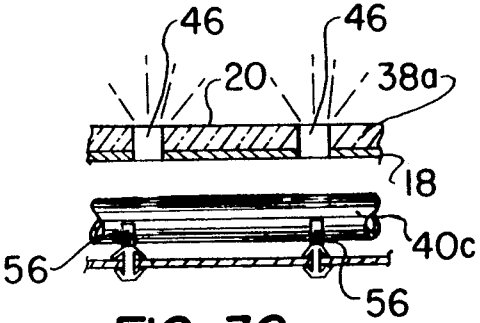

Another alternative light source 40*c* and the placement thereof is shown in FIG. 3C. The light source 40*c* is supported by a series of supports 56. The light produced by the light source 40*c* is permitted to pass through the bores 46 and enter into and through the enclosure 12*a*, *b*.

Figure 4A:
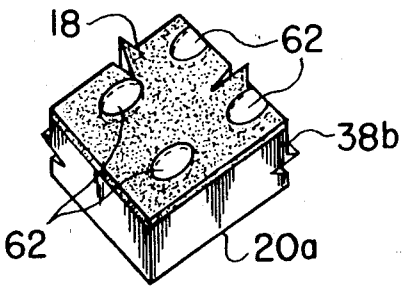
FIG. 4A is a fragmentary bottom perspective view of an alternative embodiment of the top planar mirrored panel.
Figure 4B:
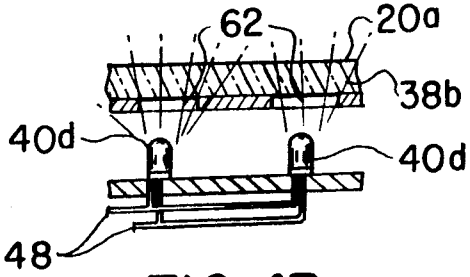
FIG. 4B is similar to FIG. 3A, showing an alternative lighting embodiment to be used in combination with the alternative top planar mirrored panel illustrated in FIG. 4A.

FIG. 4A shows an alternative of the top planar mirrored panel 38*b* having holes 62 etched through the silvered surface 18 to allow light to pass through from the hollow base 14 to the enclosure 12*a*, *b*. The light sources 40*d* shown in FIG. 4B are mounted interposed between the top planar mirrored panel 38*b* and the bottom panel 26. The light sources 40*d* are connected in parallel to the power source 68 by a pair of conductors 48.

Figure 5A:
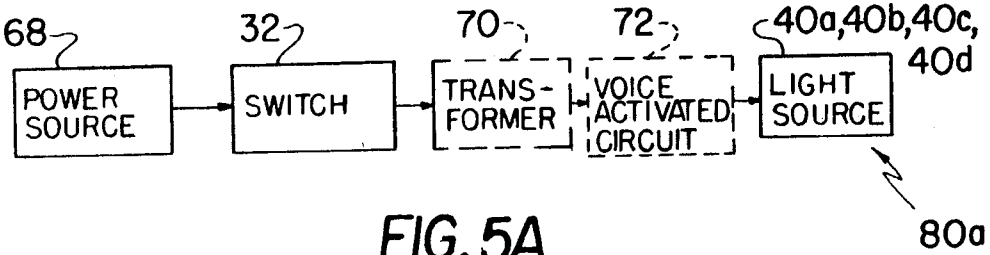
FIG. 5A is a block diagram of the present invention.

FIG. 5A shows a circuit configuration 80*a* wherein the power source 68 is connected in series with a switch 32 which enables and disables power to the light source 40*a*, 40*b*, 40*c*, 40*d*. Light sources 40*a*, 40*b*, 40*c*, 40*d* may include but are not limited to incandescent light sources, low voltage light sources, and light sources utilizing electrically excited gases. A transformer 70 may be required to provide a specific operating voltage. A control device, such as a sound activated circuit or a voice activated circuit VAC 72, may be used to continuously activate and deactivate the light source 40*a*, 40*b*, 40*c*, 40*d* in a random or prescribed manner.

Figure 5B:
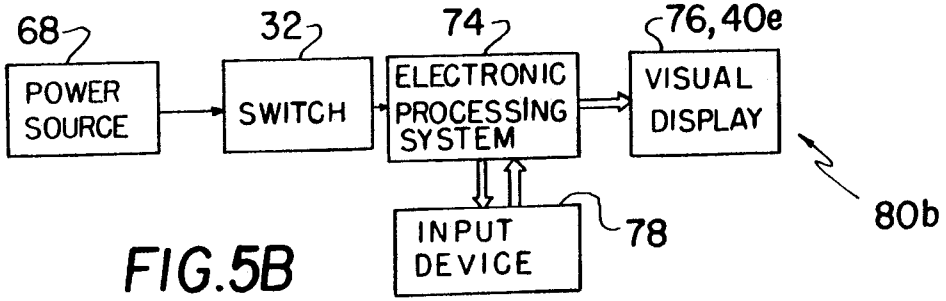
FIG. 5B is a block diagram of an alternative embodiment of the present invention.

An alternative light source 40*e* and circuit configuration 80*b* is shown in FIG. 5B. A processing system 74 and an input device 78 along with accompanying software may be used in combination with a visual display 76, such as a monochrome or color cathode ray tube, video display tube, or liquid crystal display, or some other electrical, electronic or electroluminescent display to generate an illuminating pattern. The processing system 74 and input device 78 and the accompanying software can produce and transmit either a static image or a dynamic image to the visual display 76.

It is to be understood that the present invention is not limited to the sole embodiment described above, but encompasses any and all embodiments within the scope of the following claims.

I claim:

1. A light sculpture device comprising:

a hollow base;

an enclosure mounted on said hollow base, said enclosure comprising a plurality of planar mirrored panels and at least one transparent planar mirrored panel angularly joined together to form said enclosure having an open bottom, each of said planar mirrored panels having a reflective surface and a silvered surface, whereby each said reflective surface is directed interiorly of said enclosure;

a light source fastened to said hollow base directed interiorly of said enclosure;

means to activate and deactivate said light source;

means to ventilate, whereby said light source is activated to illuminate within said hollow base to produce a reflection on each said reflective surface which is viewed through said transparent planar mirrored panel and said means to ventilate enables air to be circulated within said device;

said hollow base comprises a top planar mirrored panel having a reflective surface and a silvered surface, whereby said reflective surface is directed interiorly of said enclosure; and said top planar mirrored panel further comprises a plurality of bores.

2. The device according to claim 1, wherein said light source further comprises a plurality of light sources each supported by a pylon, whereby each of said bores has a pylon projecting therefrom.

3. The device according to claim 1, wherein said light source further comprises a plurality of light sources and each of said bores has said light source recessed therein.

4. The device according to claim 1, wherein said light source is mounted to said hollow base within said hollow base, whereby each of said bores enables light emitted from said light source to pass therethrough.

5. A light sculpture device comprising:

a hollow base;

an enclosure mounted on said hollow base, said enclosure comprising a plurality of planar mirrored panels and at least one transparent planar mirrored panel angularly joined together to form said enclosure having an open bottom, each of said planar mirrored panels having a reflective surface and a silvered surface, whereby each said reflective surface is directed interiorly of said enclosure;

a light source fastened to said hollow base directed interiorly of said enclosure;

means to activate and deactivate said light source;

means to ventilate, whereby said light source is activated to illuminate within said hollow base to produce a reflection on each said reflective surface which is viewed through said transparent planar mirrored panel and said means to ventilate enables air to be circulated within said device; and a plurality of protective panels angularly joined together around said enclosure such that said protective panels shield to protect said silvered surfaces of said planar mirrored panels leaving said at least one transparent planar mirrored panel exposed for viewing therethrough.

6. The device according to claim 1, wherein said at least one transparent planar mirrored panel includes a one-way mirror.

7. The device according to claim 3, wherein said light source includes a plurality of light sources.

8. The device according to claim 7, wherein each of said plurality of light sources includes lamps utilizing electrically excited gas.

9. The device according to claim 7, wherein each of said plurality of light sources includes an incandescent light source.

10. The device according to claim 7, wherein each of said plurality of light sources includes a low voltage light source.

11. The device according to claim 10, further comprising a transformer which provides the voltage required to activate said low voltage light source, thus forming said means to activate and deactivate said light source.

12. The device according to claim 1, further includes a sound activated circuit to temporarily activate said light source in response to sound forming said means to activate and deactivate said light source.

13. A light sculpture device comprising:

a hollow base;

an enclosure mounted on said hollow base, said enclosure comprising a plurality of planar mirrored panels and at least one transparent planar mirrored panel angularly joined together to form said enclosure having an open bottom, each of said planar mirrored panels having a reflective surface and a silvered surface, whereby each said reflective surface is directed interiorly of said enclosure;

a light source fastened to said hollow base directed interiorly of said enclosure;

means to activate and deactivate said light source;

means to ventilate, whereby said light source is activated to illuminate within said hollow base to produce a reflection on said reflective surface which is viewed through said transparent planar mirrored panel and said means to ventilate enables air to be circulated within said device; and said means to activate and deactivate said light source further comprises a processing system and an input device connected to said light source, whereby said processing system and said input device produce and transmit electrical signals which are supplied to said light source, said processing system digitally generating said electrical signals internally thereof to generate a static or dynamic image that appears as the light source on a visual display.

14. The device according to claim 1, further comprising a power source to impress potential for said light source, thus forming said means to activate and deactivate said light source.

15. The device according to claim 14, further comprising a switch means to enable and disable the potential from said power source.

16. The device according to claim 1, including a plurality of openings in combination with an exhaust fan, whereby the heat produced by said light source is removed by said exhaust fan which circulates air drawn into said base and through said plurality of openings, thus forming said means to ventilate.

17. The device according to claim 13, wherein said light source comprises a visual display screen.

18. The device according to claim 17, wherein said visual display screen is an liquid crystal display screen.

19. The device according to claim 17, wherein said visual display screen is a cathode ray tube.

* * * * *